US010746178B2

(12) United States Patent
Mei et al.

(10) Patent No.: US 10,746,178 B2
(45) Date of Patent: Aug. 18, 2020

(54) DRAINAGE APPARATUS FOR A MOTORCOMPRESSOR

(71) Applicant: Nuovo Pignone Tecnologie SRL, Florence (IT)

(72) Inventors: Luciano Mei, Florence (IT); Manuele Bigi, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 270 days.

(21) Appl. No.: 15/745,156

(22) PCT Filed: Jul. 15, 2016

(86) PCT No.: PCT/EP2016/066885
§ 371 (c)(1),
(2) Date: Jan. 16, 2018

(87) PCT Pub. No.: WO2017/009451
PCT Pub. Date: Jan. 19, 2017

(65) Prior Publication Data

US 2019/0010947 A1 Jan. 10, 2019

(30) Foreign Application Priority Data

Jul. 16, 2015 (IT) ..... 102015000034942

(51) Int. Cl.
*F04D 17/12* (2006.01)
*F04D 25/06* (2006.01)
(Continued)

(52) U.S. Cl.
CPC ..... *F04D 17/12* (2013.01); *F04D 25/0686* (2013.01); *F04D 29/705* (2013.01);
(Continued)

(58) Field of Classification Search
CPC .... F04D 17/12; F04D 25/0686; F04D 29/705; F04D 29/706; F04D 31/00; F04F 5/10
(Continued)

(56) References Cited

U.S. PATENT DOCUMENTS 4,505,645 A * 3/1985 Laguilharre ..... F04B 23/12 417/69
4,938,664 A * 7/1990 Zinsmeyer ..... F25B 31/004 417/83
(Continued)

FOREIGN PATENT DOCUMENTS

| | | |
|---|---|---|
| AU | 462 145 B2 | 6/1975 |
| JP | 2011-111990 A | 6/2011 |
| WO | 2009/111616 A2 | 9/2009 |

OTHER PUBLICATIONS

Italian Search Report and Written Opinion issued in connection with corresponding IT Application No. 102015000034942 dated Mar. 14, 2016.
(Continued)

*Primary Examiner* — Charles G Freay
(74) *Attorney, Agent, or Firm* — Baker Hughes Patent Organization

(57) ABSTRACT

A drainage apparatus for a motorcompressor comprises a first pipe with a first end configured to be inserted in a drainage sump of a motorcompressor; a second end configured to be connected to a duct of a stage of the motorcompressor; a device for generating a pressure difference between said second and said first end so that liquid is taken from said drainage sump and delivered into said duct.

15 Claims, 3 Drawing Sheets

(51) Int. Cl.
*F04D 29/70* (2006.01)
*F04D 31/00* (2006.01)
*F04F 5/10* (2006.01)

(52) U.S. Cl.
CPC ..... *F04D 29/706* (2013.01); *F04D 31/00* (2013.01); *F04F 5/10* (2013.01)

(58) Field of Classification Search
USPC ..... 417/76, 80, 81, 83, 88, 89
See application file for complete search history.

(56) References Cited

U.S. PATENT DOCUMENTS 5,382,141 A * 1/1995 Stinessen ..... E21B 43/01 166/105.5
2011/0223039 A1* 9/2011 Fang ..... F04B 23/14 417/54

OTHER PUBLICATIONS

International Search Report and Written Opinion issued in connection with corresponding PCT Application No. PCT/EP2016/066885 dated Sep. 29, 2016.
International Preliminary Report on Patentability issued in connection with corresponding PCT Application No. PCT/EP2016/066885 dated Jan. 16, 2018.

* cited by examiner

DRAINAGE APPARATUS FOR A MOTORCOMPRESSOR

BACKGROUND

The subject matter of the present disclosure relates to a turbomachine.

More particularly, the embodiments of the invention will be described specifically as applied to a subsea motorcompressor, however this will be done without losing the general approach.

According to the state of the art, a subsea motorcompressor comprises an electric motor and an operating portion, itself comprising a rotor. For example, the operating portion can be a centrifugal compressor. A shaft is connected to both the electric motor and the rotor. The rotor comprises a plurality of compression stages connected to the shaft. Each stage has an intake and a discharge duct for a process fluid. The motorcompressor stages are also placed in fluid communication with each other serially, so that the discharge of each stage feeds the intake of the next.

In a known subsea motorcompressor, the stages are assembled in a vertical configuration, meaning that the shaft itself is arranged vertically. A drainage sump is placed at the bottom, so that it can collect all of the liquids entering in the machine during the installation or operation. In another configuration, the shaft can be arranged horizontally, with the sump arranged below the stages.

The sump can then be drained through a flange on the bottom connected to an external pumping device through a valve. Disadvantageously, the drainage operation is not automatized, as it requires the intervention of the operator. Also, the current system requires that the motorcompressor be taken offline for drainage.

SUMMARY

One embodiment of the invention therefore relates to a drainage apparatus for a subsea motorcompressor. The apparatus comprises a first pipe having a first end and a second end. The first end is configured to be inserted in a drainage sump of a subsea motorcompressor. The second end is configured to be connected to an intake duct of a stage of the motorcompressor. The apparatus comprises a device for generating a pressure difference between the second and the first end, so that liquid is taken from the drainage sump and delivered into the intake.

Another embodiment relates to a motorcompressor comprises a drainage sump. The motorcompressor also comprises a plurality of stages, each having an intake and a discharge duct for a process fluid. An apparatus as the one described above is placed in fluid communication with the drainage sump and with an intake of one of the stages.

BRIEF DESCRIPTION OF THE DRAWINGS

Further details and specific embodiments will refer to the attached drawings.

In which.

DETAILED DESCRIPTION

Figure 1:
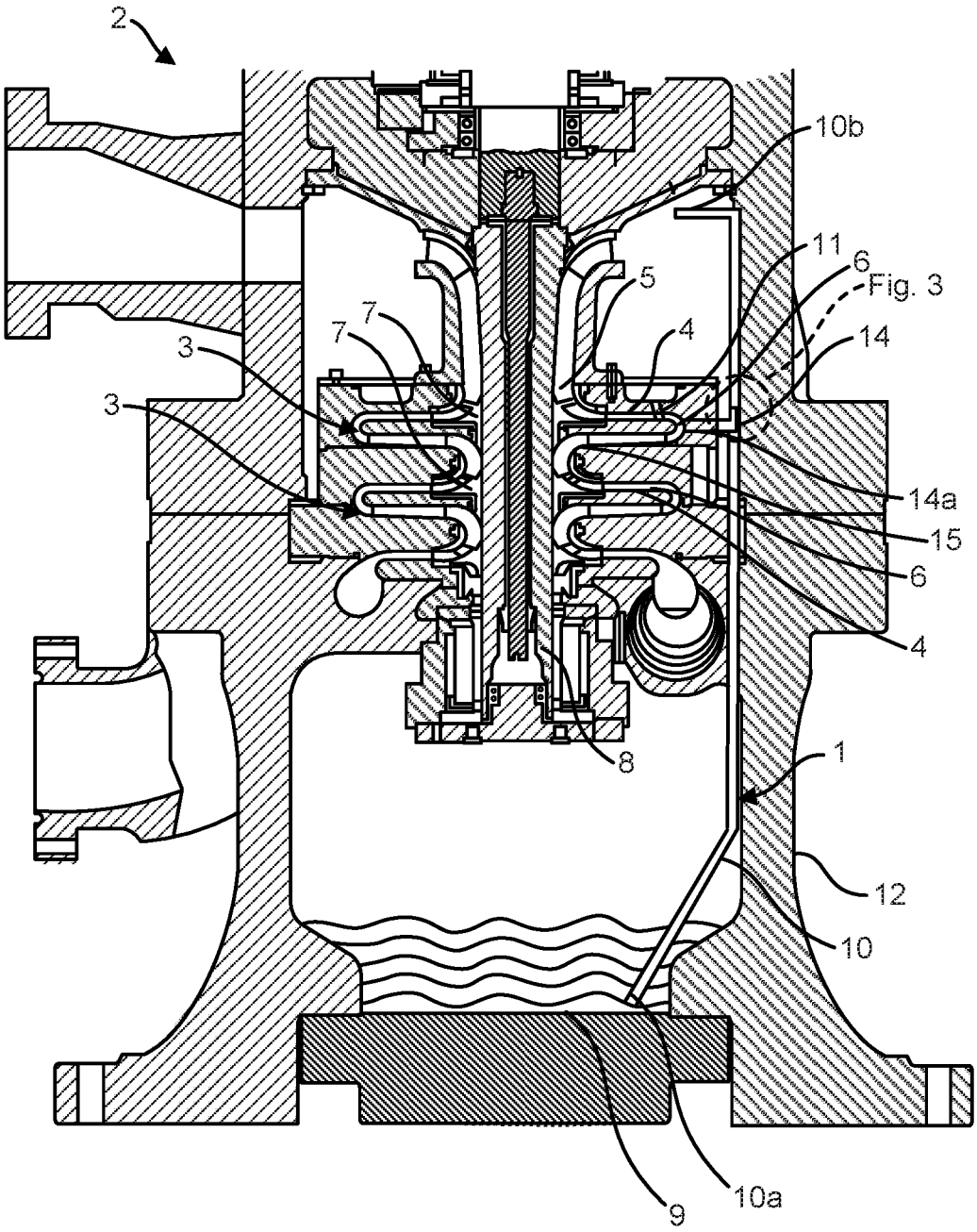
FIG. 1 is a side sectional view of a drainage apparatus for a motorcompressor according to an embodiment of the present invention.

The following description of exemplary embodiments refer to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

With reference to the attached drawings, with the number 1 is indicated a drainage apparatus for a motorcompressor according to an embodiment of the present invention. Similarly, with the number 2 is indicated a motorcompressor according to a further embodiment of the present invention.

The motorcompressor 2 comprises a plurality of stages 3. Each stage 3 has a duct 4 for a process fluid. The duct 4 has an intake 5 and a discharge section 6 for the process fluid. Inside the duct 4, each stage 3 is provided with a rotating element 7, which can be, depending on the kind of machine, either a rotor of a turbine or an impeller of a compressor.

Figure 2:
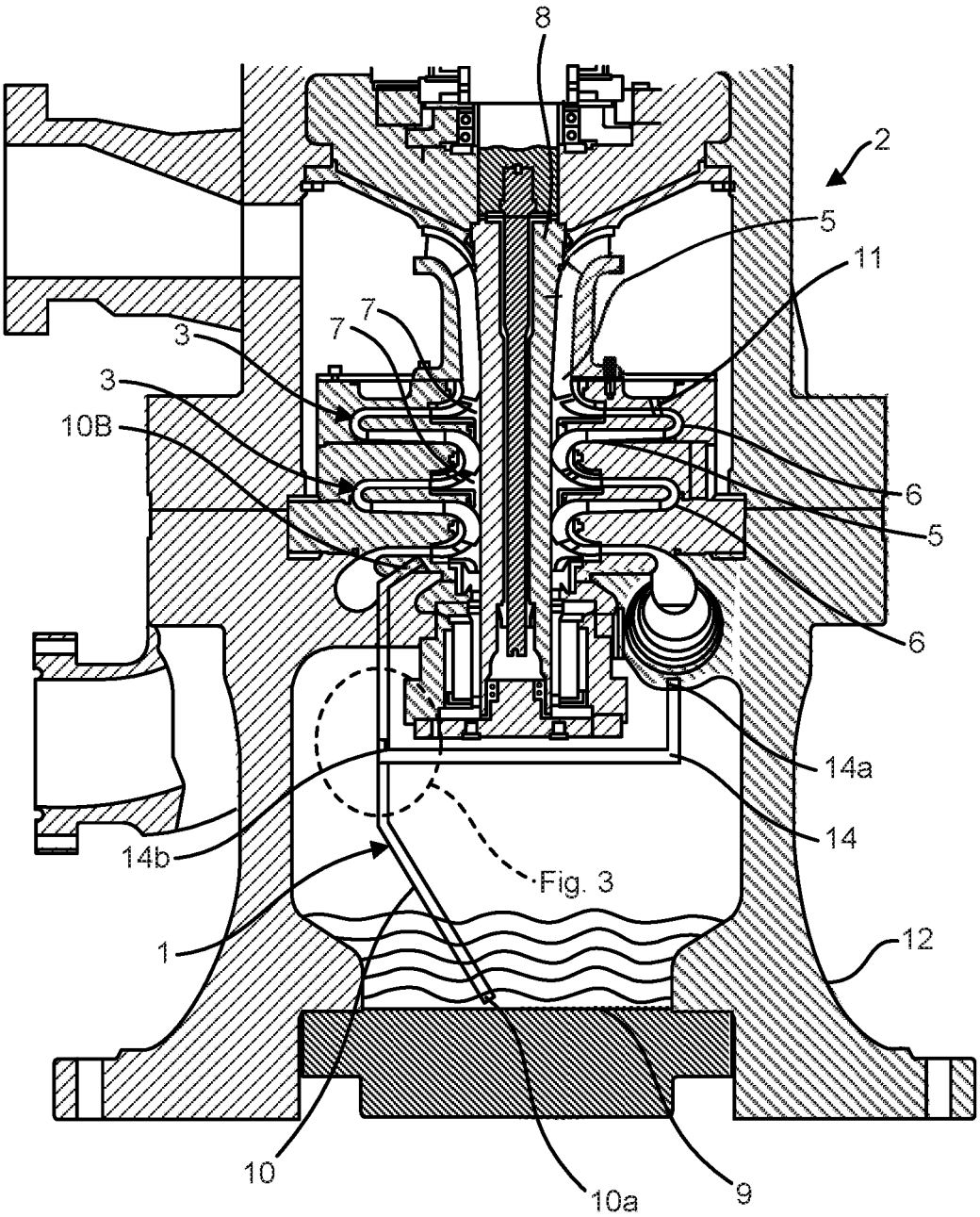
FIG. 2 is a side sectional view of a drainage apparatus for a motorcompressor according to a second embodiment of the present invention.

As it is usual in these machines, the stages 3 are arranged serially. In other words, the discharge section 6 of the duct 4 of each stage 3 is placed in direct fluid communication with the intake section 5 of the duct 4 of the next stage 3. Therefore, each stage 3 compresses the process fluid which is discharged by the previous stage 3 in the sequence. As shown in FIGS. 1 and 2, the rotating elements 7 of all the stages 3 are attached onto a single shaft 8. The shaft 8 has a rotation axis "A". Also, in order to provide and/or extract energy to the rotating elements 7, the shaft 8 is connected to an engine or to a generator (both are not shown in the drawings). According to another embodiment, not shown in the drawings, there is no shaft and the stages 3 are attached to one another.

According to the embodiments shown in FIGS. 1 and 2, the stages 3 are assembled in a vertical orientation. In other words, the shaft 8 is oriented vertically.

The motorcompressor 2 also comprises a drainage sump 9. The drainage sump 9 is placed at the bottom, below all the stages 3. In the configuration of the motorcompressor 2 shown in the figures, the sump 9 is placed below the lowest stage 3, in which is the process fluid has the highest pressure.

The motorcompressor 2 also comprises a droplet/solid particles separator 11 upstream of the first stage 3.

Also, the motorcompressor 2 is provided with an external casing 12, which encloses all the above mentioned components and protects them from the outside environment.

As shown in the figures, the apparatus 1 is installed inside the motorcompressor 2 just described. Specifically, the apparatus 1 comprises a first pipe 10. The first pipe 10 has a first end 10*a*, which is configured to be inserted in the drainage sump 9 of the motorcompressor 2. The first pipe 10 also has a second end 10*b*, which is configured to be connected to the stage 3 or to the inlet duct of the motorcompressor 2. More particularly, the second end 10*b* of the first pipe 10 is attached to the intake section 5 of the stage 3. In an embodiment, the second end 10*b* of the first pipe 10 is attached to the intake section 5 of the duct 4 of the first stage of the motorcompressor 2.

In an embodiment, the first pipe 10 is also enclosed by the casing 12 of the motorcompressor.

The apparatus 1 also comprises a device 13 for generating a pressure difference between the second 10*b* and the first end 10*a* of the first pipe 10.

In this way, the liquid is suctioned from the drainage sump 9 and delivered into the process fluid inside the motorcompressor 2.

According to the embodiments shown in FIGS. 1 and 2, the device 13 comprises a second pipe 14. Such second pipe 14 has a first end 14*a*, which is configured to be connected to a high pressure zone 15 of the motorcompressor 2. Specifically, a "high pressure zone" is defined as any part of the motorcompressor 2 in which the process fluid has a pressure higher than the compressor suction pressure. For example, the high pressure zone 15 can be a discharge section 6 of a duct 4 of any stage 3. Alternatively, the high pressure zone 15 can be a downward section of compression suction, for example just downstream the droplet separator 11.

The second pipe 14 also has a second end 14*b*, which is fluidly connected to say first pipe 10 at an intermediate point between said first and second ends 10*a*, 10*b*. Therefore, the second pipe takes a portion of the process fluid from inside the motorcompressor 2 and delivers it inside the first pipe 10.

Figure 3:
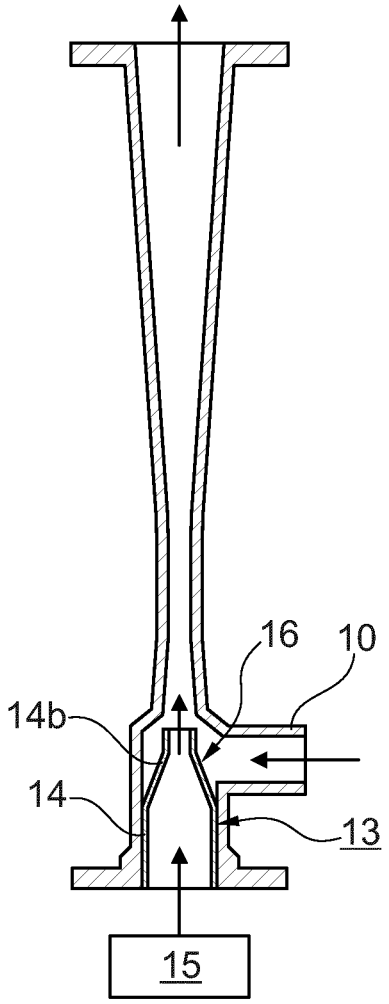
FIG. 3 is a side sectional view of a detail of the drainage apparatuses of FIGS. 1 and 2.

With more detail, in the detail shown in FIG. 3 the second end 14*b* of the second pipe 14 has a convergent portion 16, so that it can accelerate the process fluid which is delivered into the first pipe 10. Furthermore, the second end 14*b* of the second pipe 14 is arranged so that the process fluid discharged from it is directed towards the second end 10*b* of the first pipe 10. In this way, the acceleration creates a suction effect inside the first pipe 10, thus allowing the extraction of discharged liquid from the sump 9. This approach allows to create a pressure difference between the two ends of the first pipe 10 that is up to half of the pressure in the high pressure zone.

Should any further increase be necessary, it is possible to connect any number of devices 13 for creating a pressure difference as described above.

In an embodiment, and similarly to the first pipe 10, also the second pipe 14 is placed inside the casing 12 of the motorcompressor 2.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A drainage apparatus for a motorcompressor, the drainage apparatus comprising:

a first pipe arranged within a casing of said motorcompressor, comprising:

a first end inserted in a drainage sump of said motorcompressor; and a second end fluidly connected to an intake section of a duct of a stage of said motorcompressor, wherein said intake section is upstream of a rotating element of said stage and directs a process fluid towards said rotating element; and a device for generating a pressure difference between said second end and said first end so that said process fluid is taken from said drainage sump and delivered into said intake section of said duct.

2. The drainage apparatus according to claim 1, wherein said device for generating a pressure difference comprises a second pipe comprising:

a first end configured to be fluidly connected to a high pressure zone of said motorcompressor; and a second end fluidly connected to said first pipe at an intermediate point between said first and second ends of said first pipe.

3. The drainage apparatus according to claim 2, wherein said second end of the second pipe has a convergent portion to decrease the pressure of the process fluid discharged by the second end of the second pipe.

4. The drainage apparatus according to claim 1, wherein a high pressure zone is downstream of said rotating element of said stage of said motorcompressor.

5. The drainage apparatus according to claim 1, wherein a high pressure zone is downstream of a droplet separator.

6. The drainage apparatus according to claim 2, wherein said second end of the second pipe is arranged so that the process fluid discharged from the second pipe is directed towards the second end of the first pipe.

7. The drainage apparatus according to claim 1, wherein said intake section is an intake section of a first stage of said motorcompressor.

8. A motorcompressor comprising:

a casing;

a drainage sump arranged within said casing;

a plurality of stages arranged within said casing, each comprising a duct with an intake section and a discharge section for a process fluid; and a drainage apparatus placed in fluid communication with said drainage sump and with an intake section of a duct of a one of said stages, the drainage apparatus comprising:

a first pipe arranged within the casing of said motorcompressor, comprising:

a first end inserted in said drainage sump of said, motorcompressor;

a second end configured to be fluidly connected to said intake section of said a duct of the one stage of said motorcompressor, wherein said intake section is upstream of a rotating element of said one stage and directs said process fluid towards said rotating element; and a device for generating a pressure difference between said second end and said first end so that said process fluid is taken from said drainage sump and delivered into said intake section of said duct of the one stage.

9. The motorcompressor according to claim 8, wherein said-a second pipe is placed inside said casing.

10. The motorcompressor according to claim 8, wherein said device for generating a pressure difference comprises a second pipe comprising:

a first end configured to be fluidly connected to a high pressure zone of said motorcompressor; and a second end fluidly connected to said first pipe at an intermediate point between said first and second ends of said first pipe.

11. The motorcompressor according to claim 8, wherein said second end of the second pipe has a convergent portion to decrease the pressure of the process fluid discharged by the second end of the second pipe.

12. The motorcompressor according to claim 8, wherein said high pressure zone is downstream of said rotating element of said one stage of said motorcompressor.

13. The motorcompressor according to claim 8, wherein said high pressure zone is downstream of a droplet separator.

14. The motorcompressor according to claim 10, wherein said second end of the second pipe is arranged so that the process fluid discharged from the second pipe is directed towards the second end of the first pipe.

15. The motorcompressor apparatus according to claim 8, wherein said intake section is an intake section of the one stage of a first stage of said motorcompressor.

* * * * *